US012708166B2

(12) United States Patent
Hunt et al.

(10) Patent No.: US 12,708,166 B2
(45) Date of Patent: Aug. 18, 2026

(54) HELMET PROVIDED WITH AN ACCESSORY FASTENING ASSEMBLY

(71) Applicant: Cookie Composites Group Pty Ltd., Clontarf (AU)

(72) Inventors: Jeremy Robert Hunt, Bli Bli (AU); Jason Cooke, Southport (AU); Stephane Dion, Sainte-Cécile de Milton (CA)

(73) Assignee: Cookie Composites Group Pty Ltd., Clontarf (AU)

( * ) Notice: Subject to any disclaimer, the term of this patent is extended or adjusted under 35 U.S.C. 154(b) by 0 days.

(21) Appl. No.: 18/773,042

(22) Filed: Jul. 15, 2024

(65) Prior Publication Data

US 2024/0365907 A1 Nov. 7, 2024

Related U.S. Application Data

(63) Continuation of application No. 17/970,940, filed on Oct. 21, 2022, now Pat. No. 12,108,824.

(60) Provisional application No. 63/262,886, filed on Oct. 22, 2021.

(51) Int. Cl.
*A42B 3/04* (2006.01)

(52) U.S. Cl.
CPC ..... *A42B 3/0406* (2013.01); *A42B 3/044* (2013.01)

(58) Field of Classification Search
CPC ..... A42B 3/0406; A42B 3/044; A42B 3/04
See application file for complete search history.

(56) References Cited

U.S. PATENT DOCUMENTS

| | | | |
|---|---|---|---|
| 4,186,429 | A | 1/1980 | Johnston |
| 5,623,730 | A | 4/1997 | Baudou et al. |
| 6,256,797 | B1 | 7/2001 | Nemoto et al. |
| 8,733,989 | B1 | 5/2014 | Lo et al. |
| 10,016,007 | B2 | 7/2018 | Jacobsen et al. |
| 10,753,530 | B2 | 8/2020 | Liu |
| 2002/0124299 | A1 | 9/2002 | Malcolm |
| 2006/0195974 | A1 | 9/2006 | Burkhart et al. |
| 2006/0248630 | A1 | 11/2006 | Bullock et al. |
| 2010/0095437 | A1 | 4/2010 | Ikeda |
| 2015/0282548 | A1 | 10/2015 | Tulley |
| 2016/0208982 | A1 | 7/2016 | Sharron et al. |
| 2016/0212869 | A1 | 7/2016 | Gutschenritter et al. |
| 2017/0059967 | A1 | 3/2017 | Harrison et al. |
| 2017/0360139 | A1 | 12/2017 | Aguilera et al. |

(Continued)

FOREIGN PATENT DOCUMENTS

| | | | |
|---|---|---|---|
| EP | 879567 | A1 | 11/1998 |
| NO | 313859 | B1 | 12/2002 |
| WO | 2007093054 | A1 | 8/2007 |

OTHER PUBLICATIONS

Non-Final Office Action for U.S. Appl. No. 17/970,940, mailed Mar. 29, 2024, 12 pages.

*Primary Examiner* — Khaled Annis
(74) *Attorney, Agent, or Firm* — Elizabeth L. Neal; DeWitt LLP

(57) ABSTRACT

A helmet is provided, which includes a helmet shell and a fastening assembly. The fastening assembly has a mounting fixture releasably connected to the helmet shell and a release mechanism operatively connectable to the mounting fixture, where connection of the release mechanism to the mounting fixture secures the mounting fixture to the helmet shell, and disconnection of the release mechanism from the mounting fixture enables disconnection of the mounting fixture from the helmet shell.

18 Claims, 12 Drawing Sheets

(56) References Cited

U.S. PATENT DOCUMENTS

| | | | |
|---|---|---|---|
| 2018/0206578 | A1 | 7/2018 | Liu |
| 2020/0240574 | A1 | 7/2020 | Liu |
| 2021/0180642 | A1 | 6/2021 | Botkus et al. |
| 2022/0378141 | A1 | 12/2022 | Bischofberger et al. |
| 2023/0131959 | A1 | 4/2023 | Hunt et al. |

HELMET PROVIDED WITH AN ACCESSORY FASTENING ASSEMBLY

CROSS-REFERENCE TO RELATED APPLICATIONS

This application is a continuation of U.S. application Ser. No. 17/970,940, filed Oct. 21, 2022, which application claims priority under 35USC § 119 (e) of U.S. Provisional Application No. 63/262,886, filed on Oct. 22, 2021, entitled "HELMET PROVIDED WITH AN ACCESSORY FASTENING ASSEMBLY", the entirety of which is hereby incorporated by reference.

TECHNICAL FIELD

The technical field generally relates to a protective helmet adapted for use in various activities and sports such as skydiving and motorcycling, and more specifically relates to a protective helmet having a release mechanism to selectively disconnect a helmet accessory.

BACKGROUND

Historically, practitioners of the skydiving sport (or any other sports requiring the use of a helmet) tend to allocate more importance to comfort and style. However, since the release of full-face skydiving helmets in the early 1990s, drop zones and skydiving centers have been setting prerequisites relating to the gear (e.g., helmets) that the athletes/jumpers are using.

Skydiving helmets can now be provided with mechanisms and systems to improve safety of the users. However, there is still room for improvement so that these mechanisms can be easily manipulated by the users, while still being able to maintain their efficiency throughout the helmet's useful life.

SUMMARY

According to an aspect of the present disclosure, a helmet is provided. The helmet includes a helmet shell and a fastening assembly. The fastening assembly has a mounting fixture comprising a latch portion operable between a connected configuration, where the latch portion is connected to the helmet shell and secures the mounting fixture to the helmet shell, and a disconnected configuration, where the latch portion is disconnected from the helmet shell and enables disconnection of the mounting fixture from the helmet shell. The fastening assembly also has a release mechanism adapted to engage the mounting fixture to operate the latch portion in the connected configuration, the release mechanism being selectively operable to disengage the latch portion thereby operating the latch portion from the connected configuration to the disconnected configuration.

According to a possible embodiment, the mounting fixture comprises a coupling portion connectable to an accessory such that securing the mounting fixture to the helmet shell also secures the accessory to the helmet shell, and wherein operating the release mechanism enables disconnection of the mounting fixture and the accessory from the helmet.

According to a possible embodiment, the accessory is a camera.

According to a possible embodiment, the helmet comprises a visor, and the helmet shell comprises a front opening adapted to be covered by the visor, and wherein the helmet shell further comprises a fixture opening defined through the helmet shell, the fixture opening being shaped and sized to enable the latch portion to extend therethrough and connect to the helmet shell.

According to a possible embodiment, the fixture opening is defined in a top portion of the helmet.

According to a possible embodiment, the fixture opening comprises an opening perimeter defining a latching edge, and wherein the latch portion is adapted to connect to the latching edge when operated in the connected configuration.

According to a possible embodiment, the latch portion comprises a pair of latching legs adapted to extend within the fixture opening, and wherein each latching leg comprises a latching foot extending therefrom at a distal end of the latching leg, the latching foot being adapted to extend from the latching leg into the helmet shell and hook onto respective sections of the latching edge.

According to a possible embodiment, the latching legs are elongate and extend along at least 50% of a length of the respective sections one of the latching edge.

According to a possible embodiment, the latching legs are provided opposite one another and define a central passage therebetween, and wherein the release mechanism comprises a strap shaped and adapted to engage the central passage and displace the latching legs to position each latching foot below the latching edge for hooking thereonto.

According to a possible embodiment, the central passage has a passage width, and the strap has a strap width, the strap width being greater than the passage width such that the strap is adapted to push the latching legs outwardly away from one another when engaging the central passage.

According to a possible embodiment, the latching legs are adapted to bias each latching foot inwardly towards one another, and wherein disengaging the strap from the central passage enables the latching feet to move inwardly away from the latching edge and disconnect from the helmet shell.

According to a possible embodiment, the strap comprises a distal end having an end width, the end width being smaller than the passage width to facilitate engagement of the strap within the central passage.

According to a possible embodiment, each latching foot comprises an outer protrusion shaped and adapted to extend below the helmet shell and hook onto the respective sections of the latching edge, and further comprises an inner protrusion shaped and adapted to extend below the strap to facilitate engagement of the strap and support the strap through the central passage.

According to a possible embodiment, the mounting fixture comprises a strap guide extending within the central passage for guiding the strap between the latching legs and along the inner protrusions.

According to a possible embodiment, the strap guide comprises one or more support members, and wherein engagement of the strap within the central passage biases the one or more support members downwardly and against the strap to at least partially secure the strap between the support members and the inner protrusions.

According to a possible embodiment, the inner protrusions of opposite latching feet extend towards one another by between about 5% and about 50% of the strap width.

According to a possible embodiment, the release mechanism comprises a handle connected to the strap, the handle being positioned proximate a bottom portion of the helmet shell and accessible from an exterior of the helmet shell, and wherein pulling the handle disengages the strap from the central passage to operate the latch portion in the disconnected configuration.

According to a possible embodiment, the handle comprises a tab extending therefrom, and wherein the helmet shell comprises a tab slot defined in a thickness of the helmet shell and opening proximate the bottom portion, the tab being adapted to engage the tab slot when engaging the strap with the latch portion.

According to a possible embodiment, the helmet shell comprises a strap channel defined along an inner surface of the helmet shell, the strap channel extending from the bottom portion of the helmet to proximate the fixture opening, and wherein the strap is adapted to slide along the strap channel prior to engaging the latch portion.

According to a possible embodiment, the helmet further includes a foam liner provided within the helmet shell, and wherein the strap is adapted to slide along the strap channel between the foam liner and the helmet shell.

According to a possible embodiment, the foam liner comprises a strap passage defined along an outer surface thereof and facing the helmet shell, the strap passage extending from the bottom portion of the helmet to proximate the fixture opening, and wherein the strap is adapted to slide along the strap passage prior to engaging the latch portion.

According to a possible embodiment, the fastening assembly comprises a visual indicator adapted to provide visual indication of the engagement of the strap with the latch portion from an exterior of the helmet.

According to a possible embodiment, mounting fixture comprises a fixture plate adapted to abut against the helmet shell, and wherein the visual indicator comprises a hole defined through the fixture plate adjacent the coupling portion and aligned with the central passage such that the strap covers the hole when engaged with the latch portion.

According to a possible embodiment, the helmet further comprises a mounting plate removably connected to the top portion of the helmet shell, the mounting plate comprising the fixture opening.

According to a possible embodiment, the helmet comprises a plurality of mounting plates, wherein each mounting plate comprises respective fixture openings having different shapes, sizes or configurations.

According to a possible embodiment, the helmet is configured to have a single mounting plate connected thereto at any given time.

According to another aspect, a helmet is provided, which includes a helmet shell and a fastening assembly. The fastening assembly includes a mounting fixture releasably connected to the helmet shell and a release mechanism operatively connectable to the mounting fixture, where connection of the release mechanism to the mounting fixture secures the mounting fixture to the helmet shell, and disconnection of the release mechanism from the mounting fixture enables disconnection of the mounting fixture from the helmet shell.

According to another aspect, a fastening assembly for connecting an accessory to a helmet is provided. The fastening assembly includes a mounting fixture comprising a latch portion operable between a connected configuration, where the latch portion is connected to the helmet and secures the mounting fixture to the helmet, and a disconnected configuration, where the latch portion is disconnected from the helmet and enables disconnection of the mounting fixture from the helmet; and a release mechanism adapted to engage the latch portion and operate the latch portion in the connected configuration, the release mechanism being selectively operable to disengage the latch portion thereby operating the latch portion from the connected configuration to the disconnected configuration.

DETAILED DESCRIPTION

Figure 1:
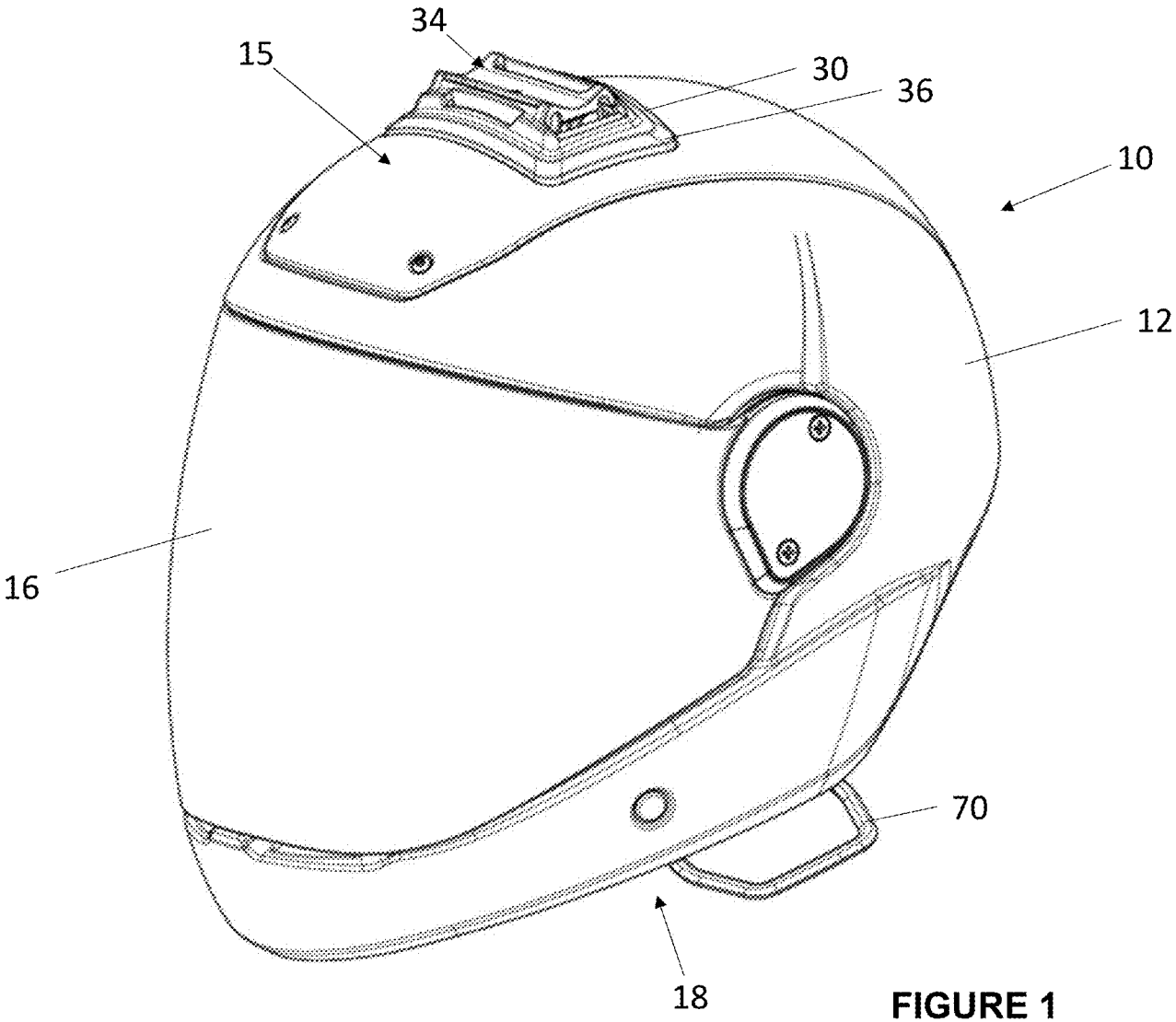
FIG. 1 is a perspective view of a helmet provided with a fastening assembly, according to an embodiment.

As will be explained below in relation to various implementations, the present disclosure describes apparatuses, systems and methods for enabling disconnection of one or more parts of a helmet during a given activity, such as disconnecting a helmet-mounted camera while skydiving, for example.

The present disclosure thus relates to a skydiving helmet provided with an accessory, such as a camera mount for having a camera coupled thereto. As will be described below, the helmet can include a fastening system configured to maintain the accessory secured to the helmet. The fastening system is selectively operable to disconnect the accessory from the helmet when required and/or desired. The fastening system can be conveniently operated from an exterior of the helmet to facilitate access thereto and disconnection of the accessory. For instance, during a skydiving exercise, a deployed parachute can become entangled around the camera mounted on the helmet. The user can therefore operate the fastening system to disconnect the camera from the helmet, thereby releasing the entangled parachute and allowing the reserve parachute to be subsequently deployed, for example.

The helmet and corresponding components can be operated for the disconnection and/or ejection of an accessory attached thereto. The fastening system can include a mounting fixture and a release mechanism. The mounting fixture is adapted to have an accessory connected thereto, and can be affixed to the helmet, and secured at a desired location via engagement with the release mechanism. The release mechanism can include an inner component (e.g., adapted to be positioned at least partially within the helmet) adapted to engage both the mounting fixture and an inner surface of the helmet to secure the mounting fixture to the helmet. The release mechanism further includes an outer component (e.g., adapted to be positioned at least partially outside and/or around the helmet) operatively connected to the inner component and being operable to disconnect the inner component from the mounting fixture, thereby releasing the mounting fixture, and the accessory connected thereto, from the helmet.

Operation of the release mechanism includes disconnection of the mounting fixture from the helmet, and can further include jettisoning the mounting fixture, and thus the accessory, from the helmet. The accessory can therefore be forcefully launched from the helmet once disconnected, for example, via springs, to facilitate the disconnection and separation of the mounting fixture from the helmet. The jettisoning feature can be particularly useful in emergency situations such as when a parachute becomes entangled in the mounting fixture, as described above. In other implementations, the mounting fixture can be simply disconnected from the helmet for maintenance, for recovery of the accessory, for coupling a different accessory to the helmet, among other possible uses.

It is noted that the various implementations of the helmet described herein can be used for various activities and for various applications such as skydiving and driving vehicles, for example, motorcycles, snowmobiles, ATVs and UTVs, or any other activities requiring a helmet. The helmet includes a helmet shell which can be modified to accommodate the fastening system. For example, an opening can be defined through the helmet shell to enable the mounting fixture to extend through the opening to position a portion thereof within the helmet shell to be coupled thereto. Alternatively, the helmet shell can include a removable plate which, when installed, defines a standard and "full" helmet shell (e.g., a dome shape helmet shell with no additional openings). The plate can be removed and/or replaced with the fastening system and corresponding components such that the helmet can be worn as a standard helmet, and modulated into a helmet with the fastening system, as required.

Figure 3:
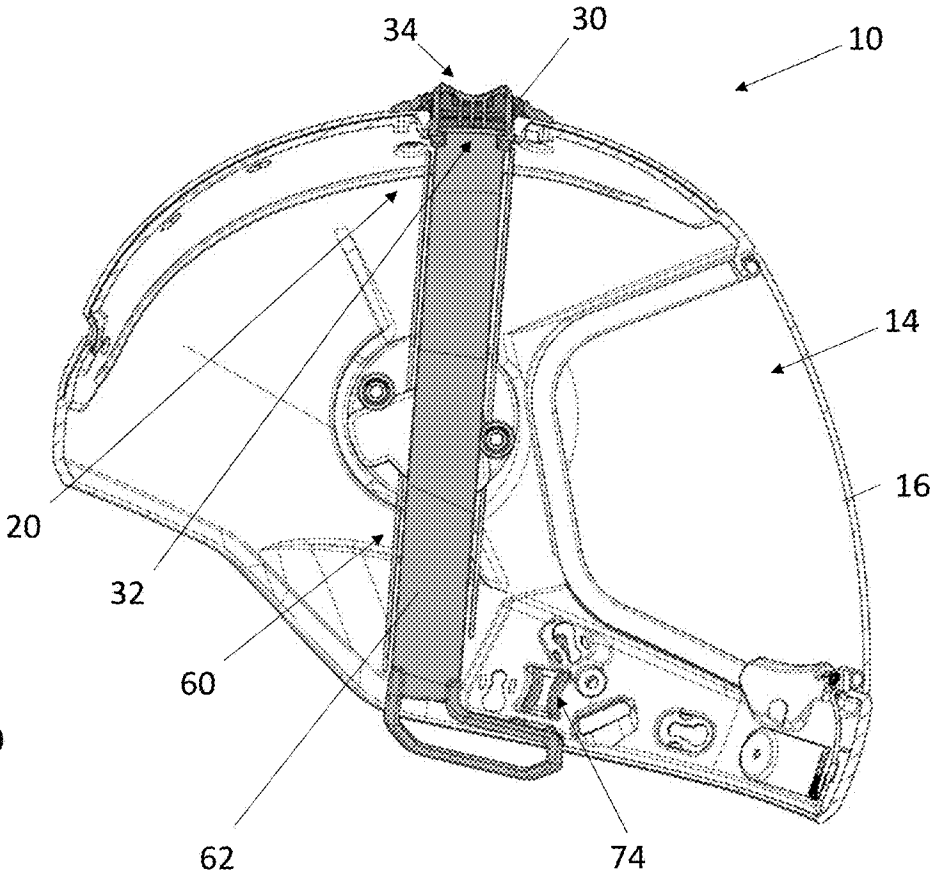
FIG. 3 is a side cross-sectional view of the helmet shown in FIG. 2, showing a release mechanism coupled to the mounting fixture, according to an embodiment.
Figure 2:
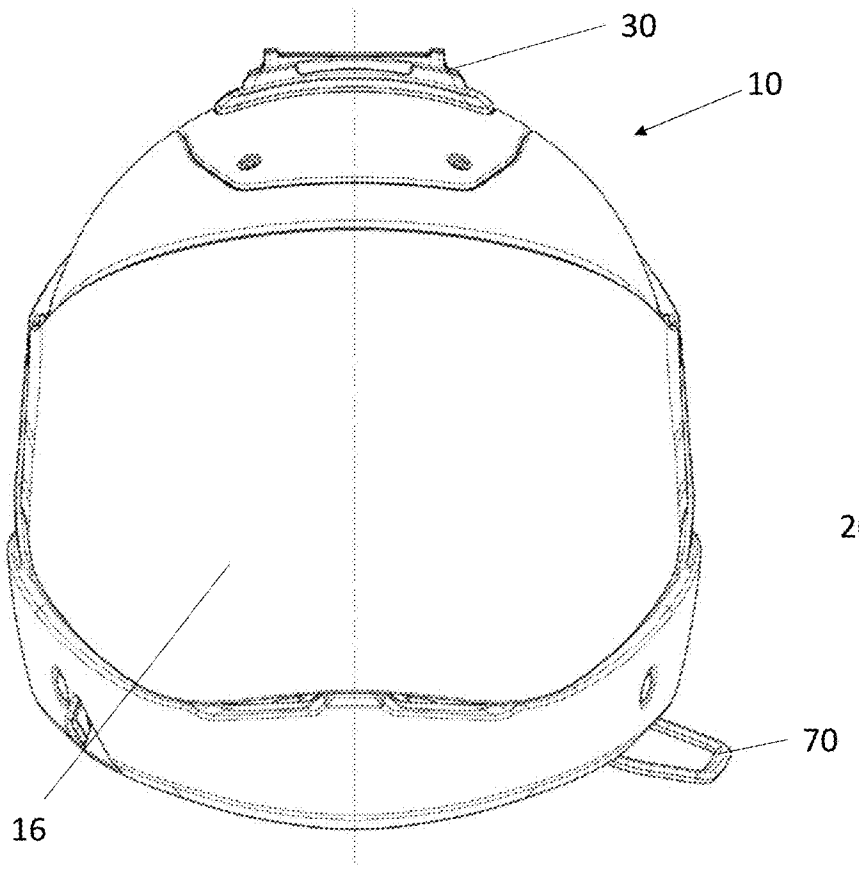
FIG. 2 is a front view of the helmet shown in FIG. 1, showing a mounting fixture coupled to a top portion of the helmet, according to an embodiment.
Figure 9:
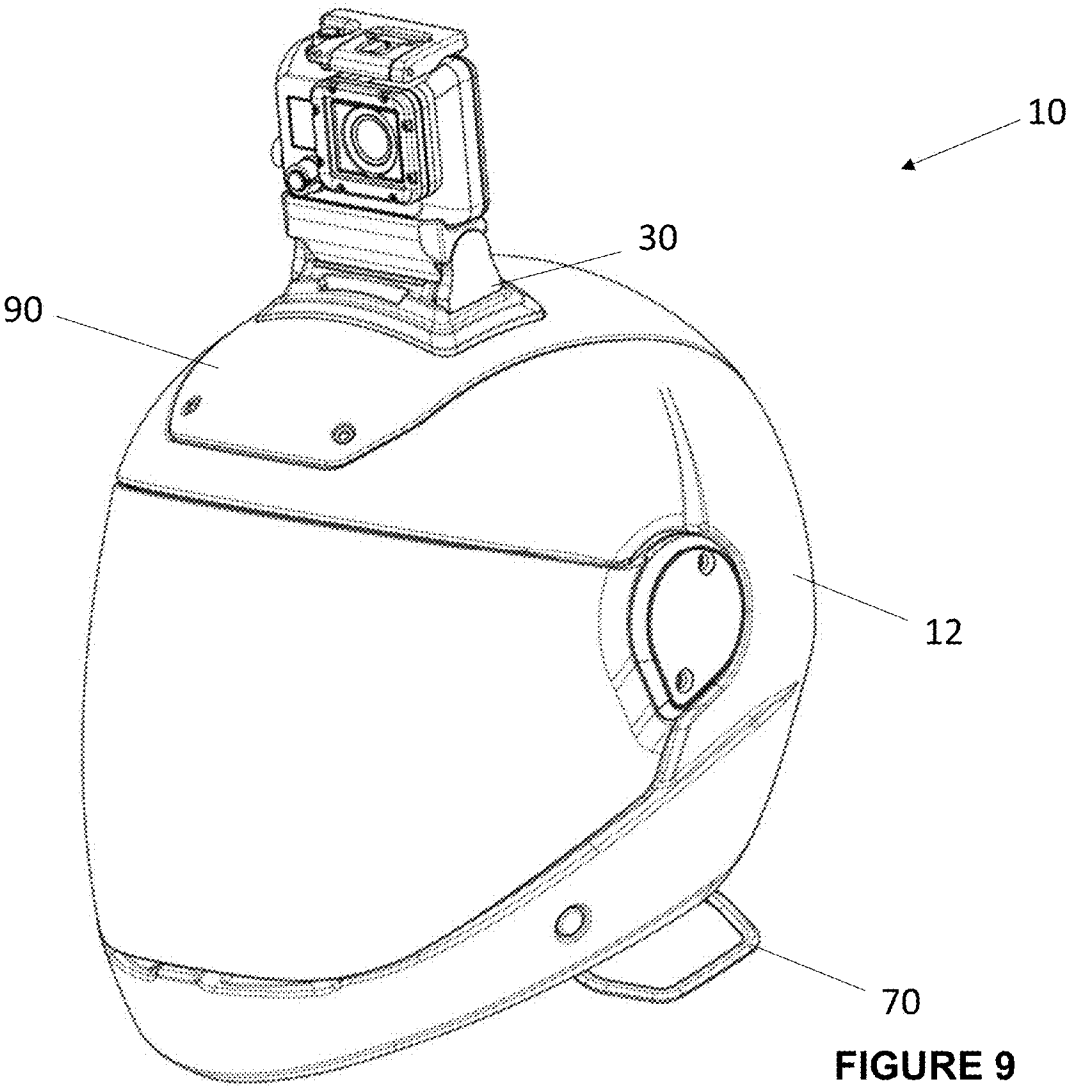
FIGS. 9 to 11 are perspective, front and cross-sectional views of the helmet shown in FIG. 1, showing an accessory connected to the mounting fixture, according to an embodiment.
Figure 11:
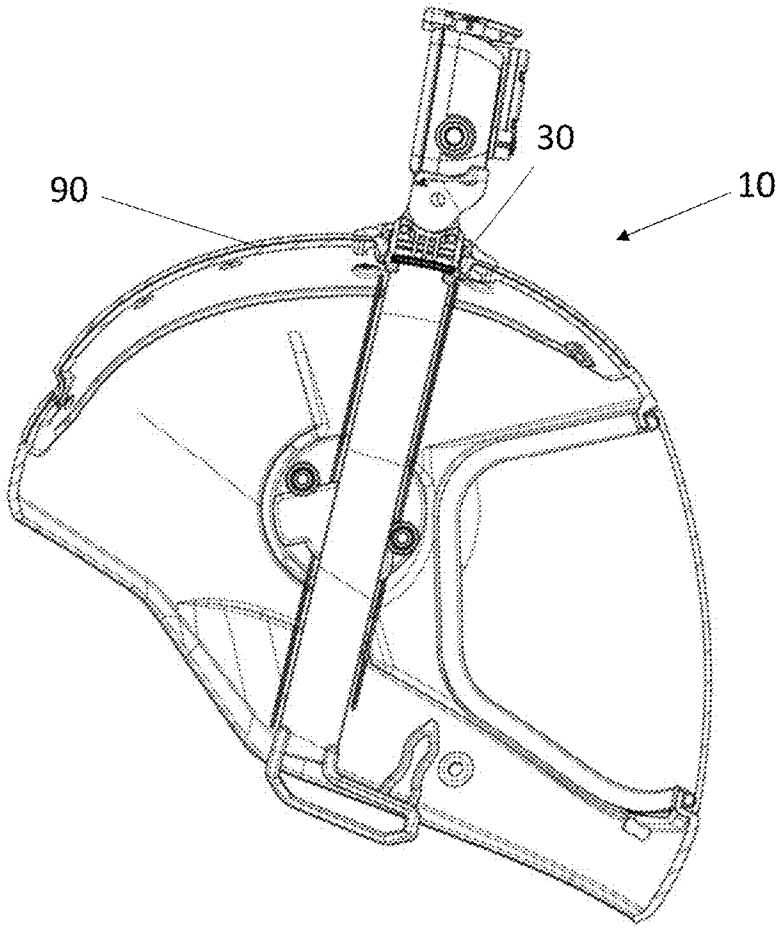
Figure 10:
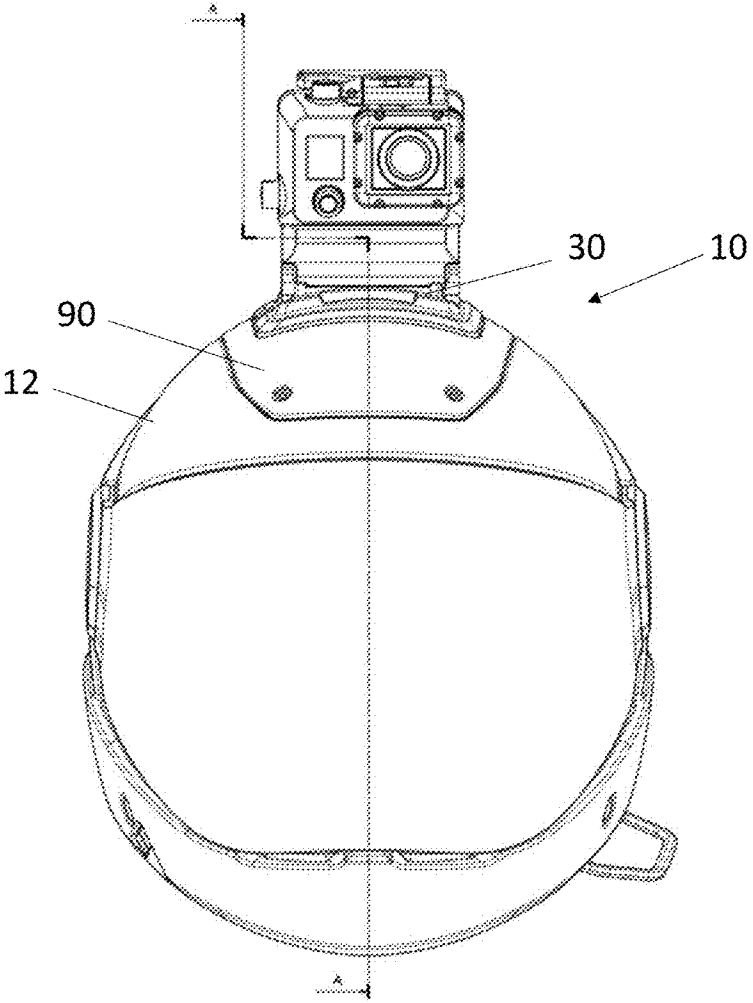

Referring to FIGS. 1 to 3, a helmet 10 according to a possible embodiment is shown. The helmet includes a helmet shell 12 having a front opening 14 covered by a visor 16. It is noted that the visor 16 can be moved between a raised position to enable the wearer to uncover the front opening 14, and a lowered position (seen in FIG. 1) to cover the front opening 14 and protect the wearer's face and eyes. The helmet 10 also includes a fastening assembly 20 adapted to fasten, or otherwise enable connection of an accessory to the helmet 10 (such as shown in FIGS. 9 to 11). The fastening assembly 20 can be operable to selectively disconnect the accessory and enable the accessory to be removed from the helmet 10.

In some embodiments, the fastening assembly 20 includes a mounting fixture 30 and a release mechanism 60. The mounting fixture 30 is adapted to hold the accessory (e.g., the accessory is shaped and adapted to be coupled to the mounting fixture 30), and is removably connectable to the helmet shell 12. The release mechanism 60 is operatively connected to the mounting fixture 30 and is operable to selectively disconnect the mounting fixture 30 from the helmet shell 12. As will be further described below, the mounting fixture 30 is secured to the helmet shell 12 when the release mechanism 60 is engaged therewith, and is adapted to be removed from the helmet when the release mechanism 60 is disengaged. Alternatively, the mounting fixture 30 can be secured to the helmet shell 12 via any other suitable mechanism (e.g., other than being engaged by the release mechanism 60) and is adapted to be disconnected upon operation of the release mechanism.

Figure 4A:
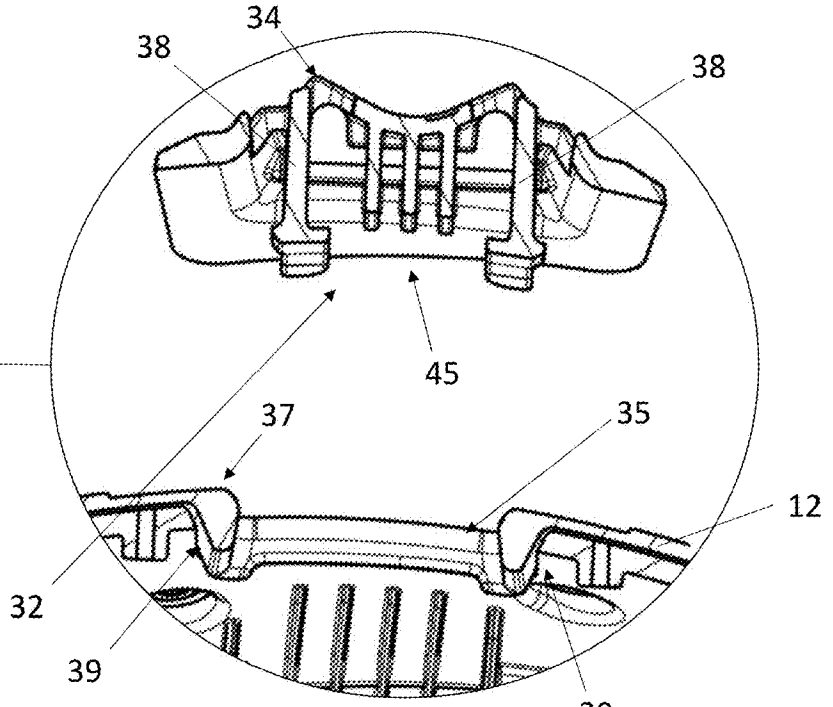
FIG. 4A is an enlarged view of a portion of FIG. 4, showing the mounting fixture comprising latching legs, according to an embodiment.
Figure 4:
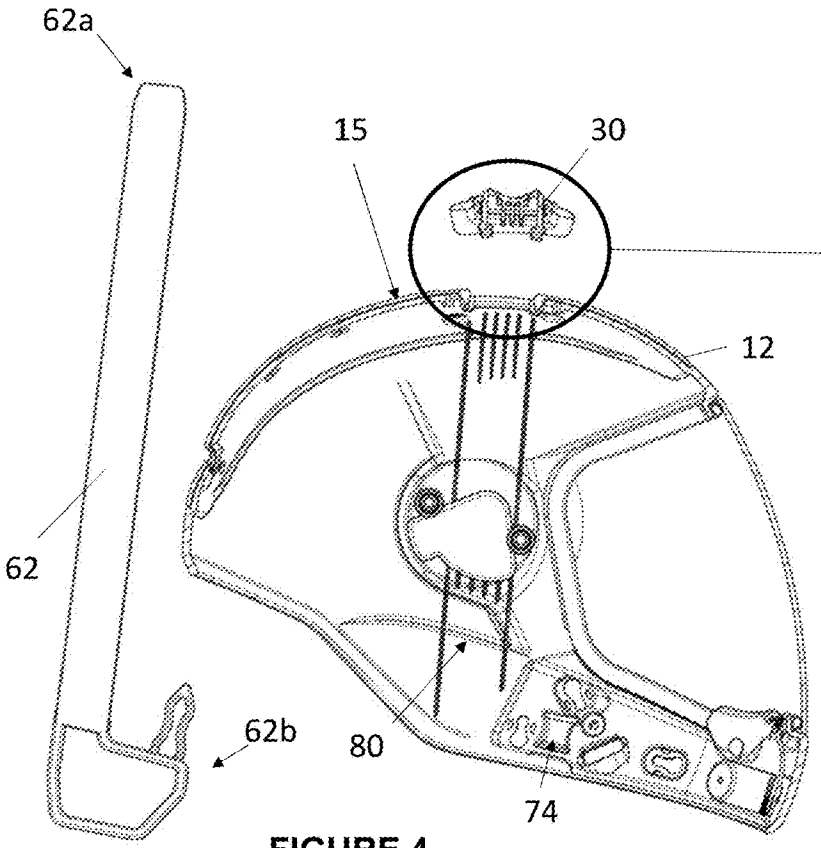
FIG. 4 is a partially exploded view of the helmet shown in FIG. 3, showing the mounting fixture and the release mechanism spaced from the helmet.

With reference to FIGS. 4 and 4A, in addition to FIGS. 1 to 3, the mounting fixture 30 can be mounted to any suitable portion of the helmet shell 12, such as on a top portion 15 thereof, as seen in the figures, although it is noted that other configurations are possible, such as connecting the mounting fixture 30 on a lateral portion of the helmet shell, for example. In some embodiments, the mounting fixture 30 includes a latch portion 32 adapted to connect to the helmet shell 12, and a coupling portion 34 adapted to connect to an accessory, such as a camera or a speaker, for example. As such, the accessory can be connected to the helmet 10 via the fastening assembly 20 (e.g., via the mounting fixture 30). In this embodiment, the latch portion 32 can be configured in a connected configuration, where the latch portion 32 is connected to the helmet shell 12 to secure the mounting fixture 30 to the helmet shell 12, and a disconnected configuration, where the latch portion can be disconnected from the helmet shell 12, thereby enabling disconnection and removal of the mounting fixture 30 (and thus the accessory) from the helmet shell 12.

Figure 5:
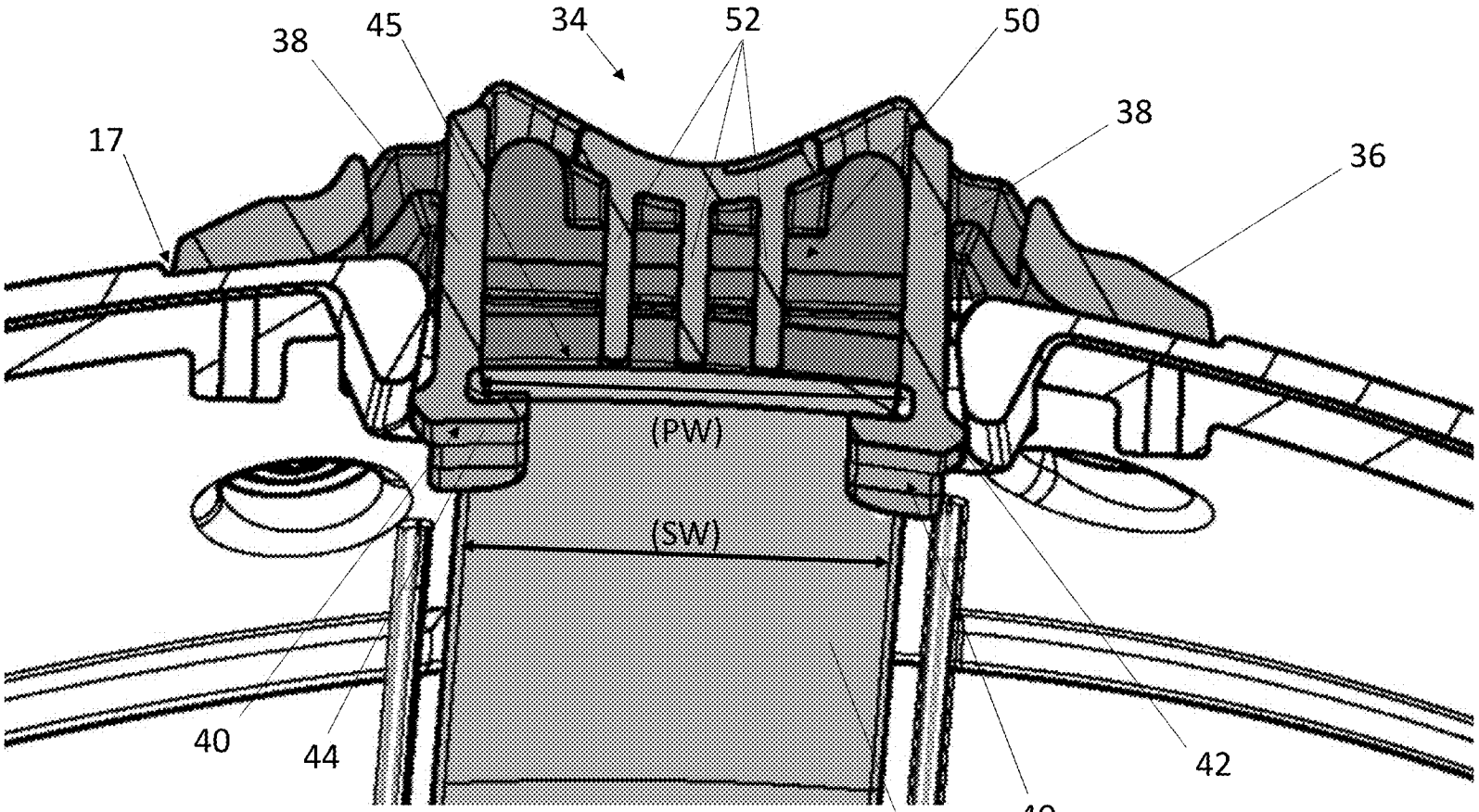
FIG. 5 is an enlarged view of the mounting fixture coupled to the helmet shell, showing the latching legs engaging a fixture opening ledge, according to an embodiment.

With reference to FIGS. 4 to 5, in some embodiments, the helmet shell 12 can be provided with a fixture opening 35 defined in the top portion 15 thereof. The mounting fixture 30 can include a fixture plate 36 adapted to abut against the helmet shell 12, with the latch portion 32 extending below the fixture plate 36 in order to extend within and through the fixture opening 35. Referring more specifically to FIG. 4A, the fixture opening 35 has an opening perimeter 37 defining a latching edge 39 onto which the latch portion 32 can connect to when in the connected configuration. In this embodiment, the latching edge 39 includes downwardly extending elements on which the mounting fixture 30 can hook onto, as will be described further below.

The latch portion 32 illustratively extends downwardly below the fixture plate 36 such that a section thereof can extend within the fixture opening 35 and the helmet shell 12 when the fixture plate abuts against the top portion. The portion of the latch portion 32 which extends within the helmet shell is adapted to cooperate with the latching edge 39 in order to secure the mounting fixture to the helmet. In some embodiments, the helmet shell 12 includes an inset region 17 (also seen in FIG. 8) defined around the fixture opening 35 which is shaped and adapted to conform to the shape of the fixture plate 36. The inset region 17 illustratively includes an inset region rim such that the fixture plate 36 can be inserted within the inset region 17. Thereby, the position of the mounting fixture 30 on the helmet shell 12 is restricted to within the inset region 17 due to the inset region rim blocking movement of the fixture plate 36 along the surface of the helmet shell 12.

In some embodiments, the latch portion 32 includes one or more latching legs 38 adapted to extend within the fixture opening 35 and connect to (e.g., latch onto) the latching edge 39 of the opening 35. In some embodiments, each latching leg 38 includes a latching foot 40 extending at a distal end thereof at an angle so as to engage the latching edge 39 (e.g., the downwardly extending elements). Each latching foot 40 can have an outer protrusion 42 shaped and adapted to complement the latching edge and enable the latching foot 40 to hook onto respective sections of the latching edge 39. In this embodiment, the latch portion 32 includes a pair of latching legs 38 provided opposite one another and are adapted to connect to opposite sides of the fixture opening 35. In particular, the latching legs 38 connect to opposite sections of the latching edge 39 via respective latching feet 40. As illustrated in FIGS. 4A and 5, the latching legs 38 extend opposite one another and define a central passage 45 therebetween. As will be described further below, the release mechanism 60 is configured to engage the central passage 45 and bias the latching legs 38 away from one another to position the latching feet 40 below the latching edge 39 to engage the latching edge 39.

Figure 6:
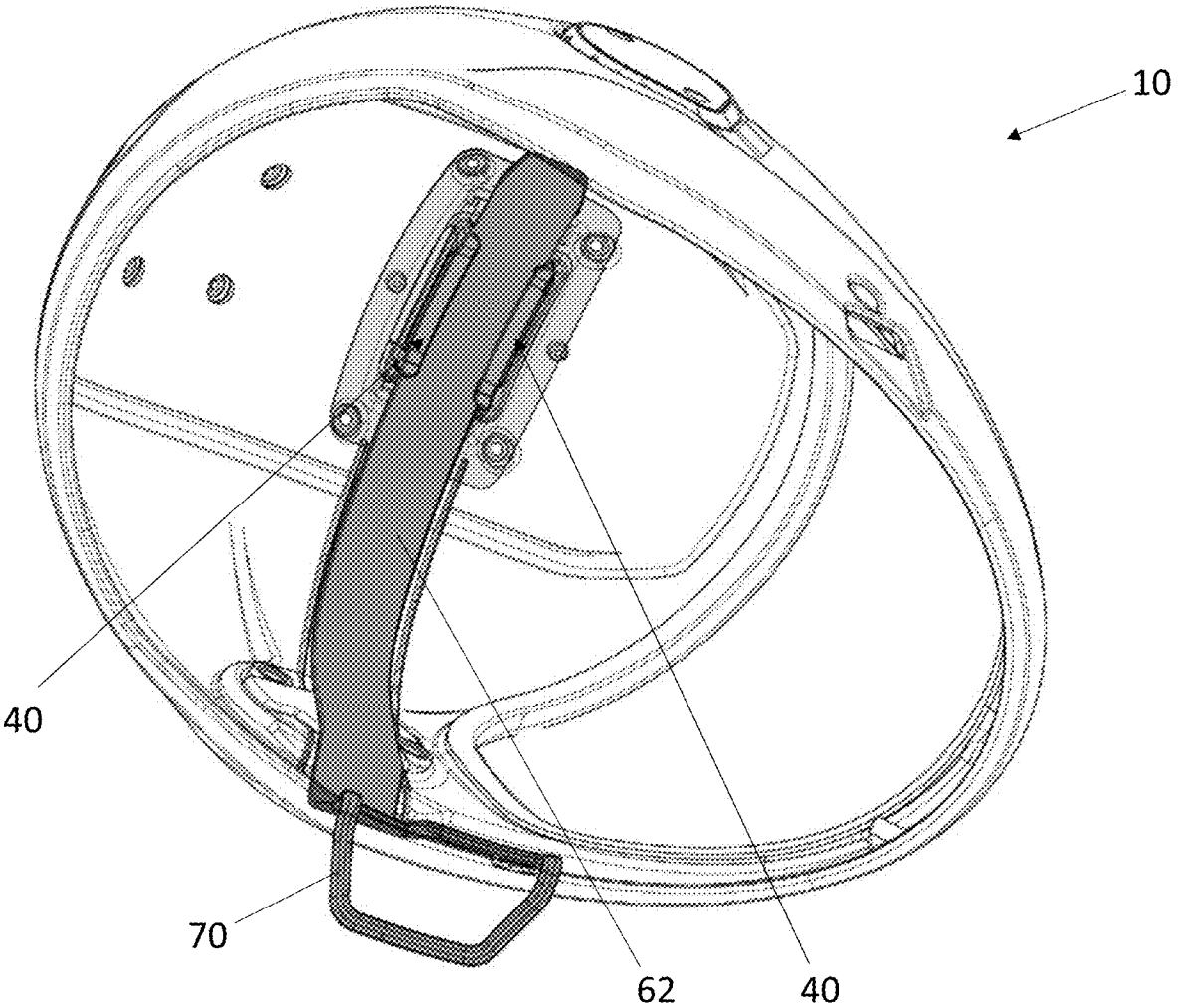
FIG. 6 is a bottom perspective view of the helmet shown in FIG. 1, showing a strap engaging between the latching legs, according to an embodiment.

Now referring to FIG. 6, the latching foot 40 of each latching leg can be elongated and extend along substantially the entire side of the fixture opening 35, and therefore along an entire length of the corresponding section of the latching edge 39. However, it is appreciated that other configurations are possible, such as having a plurality of latching legs 38 dispersed along a same side of the fixture opening 35, where the latching feet 40 are smaller and extend along only a portion of the corresponding section of the latching edge 39. In some embodiments, the latching legs 38 and corresponding latching feet 40 are adapted to extend along about 50% of a length of the sections of the latching edge 39, although they can extend along any other suitable length thereof.

Referring broadly to FIGS. 3 to 6, in some embodiments, the release mechanism 60 is adapted to engage the mounting fixture 30, and more particularly the latch portion 32 thereof to configure the latch portion 32 in the connected configuration and secure the mounting fixture to the helmet shell 12. In other words, the latch portion 32 by itself can be adapted to remain removably coupled to the helmet shell 12, where the mounting fixture 30 and the accessory connected thereto can be pulled and detached from the helmet shell 12 (e.g., the mounting fixture can be removed from within the opening 35). However, when engaging the release mechanism 60 with the latch portion 32, the mounting fixture 30 becomes secured to the helmet shell 12, thereby preventing disconnection therefrom, even when a force is applied (e.g., when the mounting fixture 30 is pulled). In this embodiment, the release mechanism 60 is selectively operable to disengage the latch portion 32 to operate the latch portion from the connected configuration to the disconnected configuration. Therefore, the mounting fixture 30 and the accessory remain secured to the helmet shell 12 as long as the release mechanism 60 is not operated (e.g., as long as the release mechanism remains engaged with the latch portion 32).

In this embodiment, the release mechanism 60 includes a strap 62, shaped and adapted to engage the latch portion 32 for operating the latch portion from the disconnected configuration to the connected configuration. In some embodiments, operating the release mechanism 60 can include removing the strap 62 from latch portion 32 to enable the mounting fixture 30 to disconnect from the helmet 12, and therefore enable removal of the accessory. In this embodiment, when in the disconnected configuration, the latching legs 38 can be adapted to extend downwardly and at an angle toward one another. As such, the latching feet 40 are spaced from the latching edge 39 to prevent having the mounting fixture 30 be secured to the helmet when in the disconnected configuration.

The strap 62 is adapted to engage the central passage 45 defined between the latching legs 38 of the latch portion 32, and is shaped and sized to push the latching legs 38 outwardly away from one another to have the latching feet 40 latch onto respective sections of the latching edge 39. As illustrated in FIG. 5, the central passage 45 has a passage width (PW), and the strap has a strap width (SW). The strap width is generally greater than the passage width (e.g., when the latch portion is in the disconnected configuration) such that the strap 62 is adapted to push the latching legs 38 outwardly away from one another when engaging the central passage 45. It should be noted that once the strap 62 is inserted into the central passage 45, the latching feet 40 are adapted to latch onto respective portions of the latching edge 39, thereby securing the mounting fixture 30 to the helmet shell 12.

Figure 7:
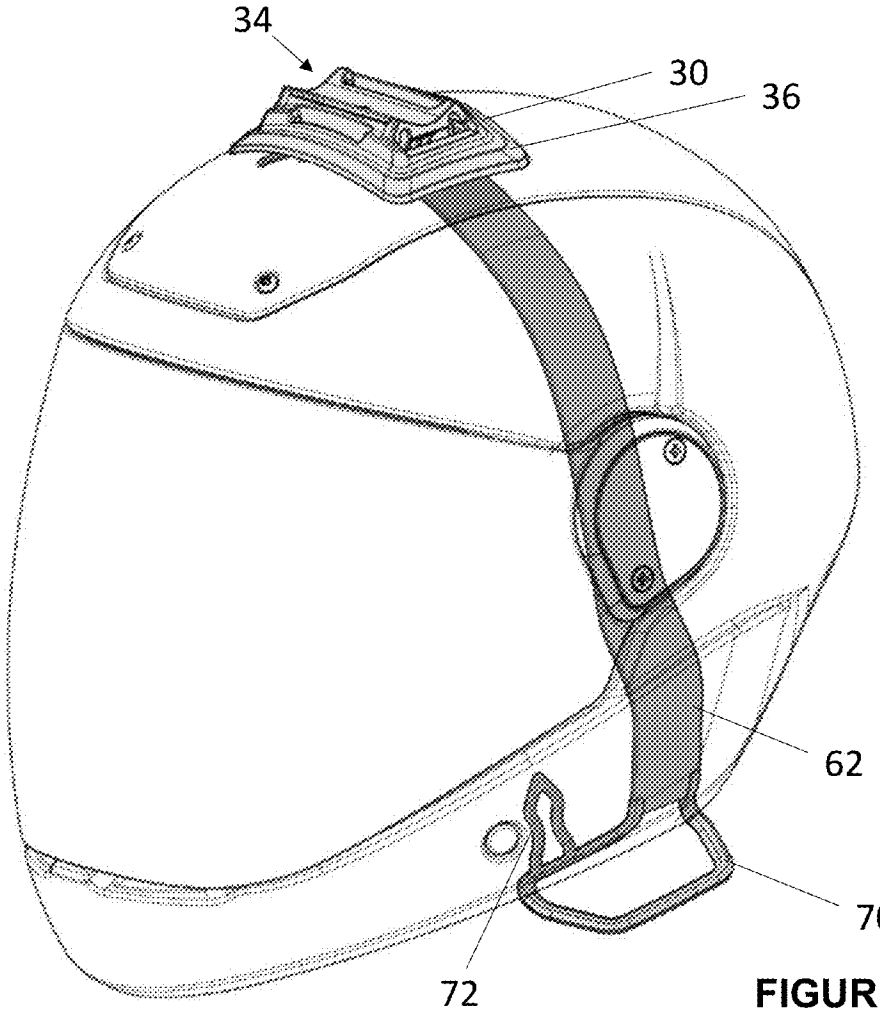
FIG. 7 is a perspective view of the helmet shown in FIG. 1, showing a partially see-through helmet shell illustrating the strap engaged along an inner surface of the helmet shell, according to an embodiment.
Figure 8:
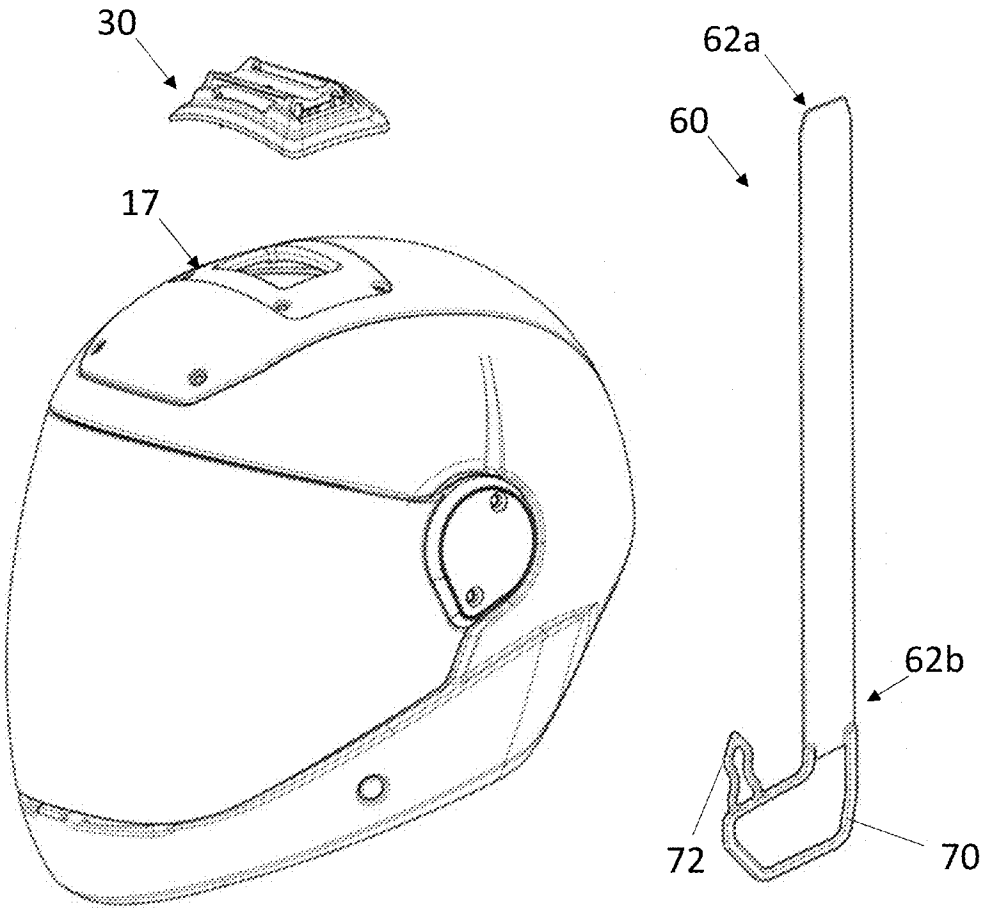
FIG. 8 is an exploded perspective view of the helmet shown in FIG. 1, showing a handle positioned at a proximal end of the strap, according to an embodiment.

It should thus be noted that having the strap 62 engage the central passage 45 pushes against the legs to latch onto the latching edge 39, and that removing the strap from the central passage 45 allows the latching legs 38 to revert to their initial position (i.e., with the latching feet being spaced from the latching edge 39). As seen in FIGS. 7 and 8, the strap 62 can have a tapered distal end 62*a* having a gradually increasing width to facilitate engagement of the strap 62 in the central passage. Moreover, with reference to FIG. 5, each latching foot 40 can include an inner protrusion 44 shaped and adapted to extend below the strap 62 to further facilitate engagement of the strap 62 in the central passage 45. The inner protrusions 44 can be adapted to support the strap 62 when it is engaged in the central passage 45 and prevent accidental or otherwise undesired disengagement of the strap 62. In some embodiments, the inner protrusions extend toward one another by about 5% to 50% of the strap width. It is thus noted that if each latching foot extends by about 50% of the strap width, that the pair of latching feet therefore covers 100% of the bottom of the strap 62. It should, however, be appreciated that other configurations are possible for supporting the strap within the central passage.

The mounting fixture 30 can further include a strap guide 50 provided between the latching legs 38 for guiding the strap 62 along the central passage 45. As seen in FIG. 5, the strap guide 50 can include guide members 52 extending downwardly from the coupling portion 34 (e.g., from a top portion of the mounting fixture) between the latching legs 38. The guide members 52 can be adapted to contact a surface of the strap 62 when it is engaged in the latch portion 32, thereby stabilizing the strap 62 within the central passage 45. The guide members 52 can have any suitable length to extend along the central passage 45, such as generally the same length as the latching feet 40, for example. As seen in FIG. 5, the strap 62 can be positioned between the inner protrusions 44 of the latching feet 40 and the guide members 52 of the strap guide 50.

In some embodiments, the strap guide 50 is adapted to provide a downward force on the strap 62, thereby compressing the strap 62 between the guide members 52 and the inner protrusions 44 of the latching feet 40. In this embodiment, the latching legs 38 and the guide members 52 are cooperatively coupled such that moving the latching legs 38 away from one another (e.g., when engaging the strap 62 within the central passage 45) biases the guide members 52 downwardly towards the strap 62 to at least partially secure the strap between the support members 52 and the inner protrusions 44. The guide members 52 can include one or more strips of material extending downwardly from the top surface of the mounting fixture (e.g., three strips are shown in the illustrated embodiment of FIG. 5), although other configurations are possible.

With reference to FIGS. 6 to 8, the release mechanism 60 includes an actuator operable to disengage the strap 62 from the latch portion of the mounting fixture 30. In this embodiment, the actuator includes a handle 70 connected to the strap 62 at a proximal end 62*b* thereof. The handle 70 can be grasped and pulled in order to remove the strap 62 from between the latching legs (i.e., from the central passage) to enable disconnection of the mounting fixture from the helmet. The handle 70 can illustratively be provided proximate a bottom portion of the helmet when the strap is engaged with the mounting fixture. More specifically, the handle 70 can be positioned proximate the bottom opening of the helmet through which a user would put the helmet on their head. In the illustrated embodiments, the handle 70, or at least a portion thereof, extends outwardly from beneath the helmet to be accessible from an exterior of the helmet to facilitate grasping the handle 70. For example, the handle 70 can extend laterally on a side of the helmet, either near the front (e.g., proximate the bottom jaw of a user wearing the helmet), near the center (e.g., aligned with the corresponding ear of a user wearing the helmet) or near the back of the helmet.

In some embodiments, the strap 62 corresponds to an internal element of the release mechanism 60 and the handle 70 corresponds to an external element of the release mechanism. As such, the strap 62 can be completely hidden within the helmet shell 12 when engaged with the mounting fixture 30, as seen in FIG. 9. Referring back to FIG. 4, the helmet shell 12 can be provided with a strap channel 80 defined along a portion of the inner surface of the helmet shell 12. In some embodiments, the strap channel 80 extends from the bottom portion of the helmet to the fixture opening 35 which can be located on the top portion of the helmet. The strap channel 80 is shaped and adapted to facilitate positioning the strap 62 to engage the mounting fixture. For example, the strap channel 80 can have an inlet configured to allow the strap 62 to enter the channel 80, and/or sides configured to prevent the strap from exiting the channel 80. In other words, in some embodiments, the strap 62 can only enter and exit the channel via the inlet. Furthermore, it is appreciated that the strap channel 80 is advantageously aligned with the central passage of the latch portion such that sliding the strap 62 along the channel 80 aligns the strap with the central passage to facilitate engagement therewith.

The strap channel 80 can be entirely defined along the inner surface of the helmet shell 12 to completely conceal the strap within the helmet, for example. A helmet liner, or general padding (e.g., foam), can be provided along the inner surface of the helmet to at least partially cover the strap channel 80 and help maintain the strap 62 within the strap channel. In other embodiments, the strap channel 80 can be defined along the liner of the helmet instead of along the inner surface of the helmet. Alternatively, both the inner surface of the helmet and the outer surface of the liner can be provided with respective strap channels configured to cooperate to receive the strap therein.

In yet other embodiments, the strap channel can be defined in a thickness of the helmet shell 12, with the inlet being defined proximate the bottom portion, and an outlet of the strap channel being defined proximate the top portion where the mounting fixture is positioned. Alternatively, the strap channel can have an exterior portion defined on an outer surface of the helmet shell, with the inlet of the strap channel being defined at the end of the exterior portion to transition to an internal portion which is aligned with the central passage. The handle can remain positioned proximate the bottom portion of the helmet, or can alternatively be positioned proximate the inlet of the strap channel, which can be defined at any suitable location on the helmet shell.

Referring to FIGS. 4, 8 and 11, the handle 70 can be coupled to the helmet shell 12 and at least partially retained thereon to prevent undesired and/or accidental disengagement of the release mechanism. In this embodiment, the handle 70 can be provided with a retainment member configured to engage the helmet shell 12 to at least partially retain the handle thereon prior to being actuated (e.g., pulled) to disengage the strap from the mounting fixture. The retainment member can include a tab 72 extending from a portion of the handle 70 to extend within the helmet shell to engage a complementarily shaped slot or inlet. As seen in FIG. 4, the helmet shell 12 can be provided with a tab slot 74 defined along the inner surface thereof proximate the bottom portion of the helmet. The tab 72 is shaped and sized to engage the tab slot 74, and is positioned to engage the tab slot 74 when the release mechanism 60 engages the mounting fixture 30 (e.g., when the strap engages the latch portion 32). The tab 72 can be generally flexible and have an hourglass shape to enable engagement with the tab slot 74, and allow the tab slot 74 to at least partially and/or passively retain it therein.

Figure 12:
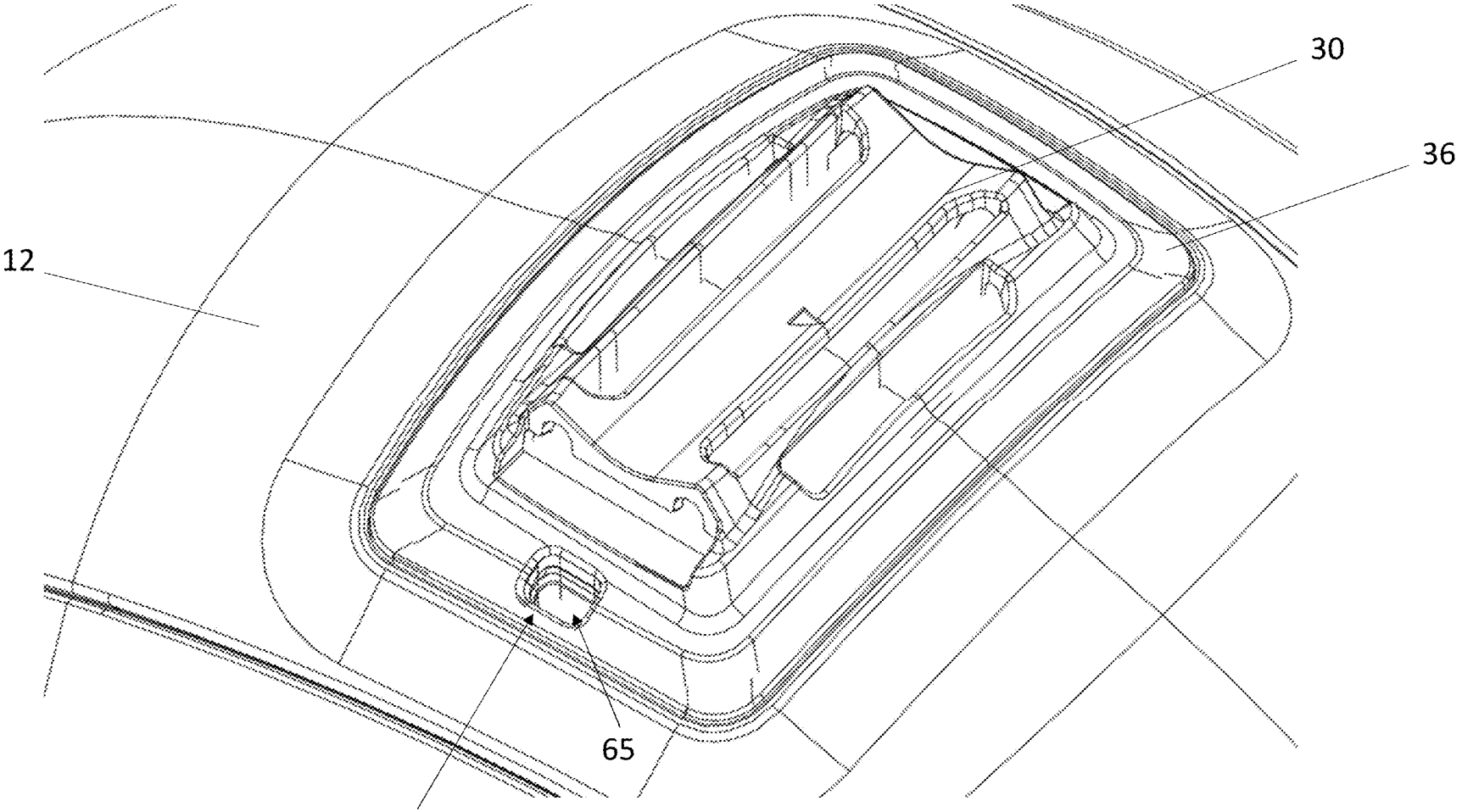
FIG. 12 is an enlarged view of the top portion of the helmet, showing the mounting fixture provided with a visual indicator hole defined therethrough, according to an embodiment.
Figure 14:
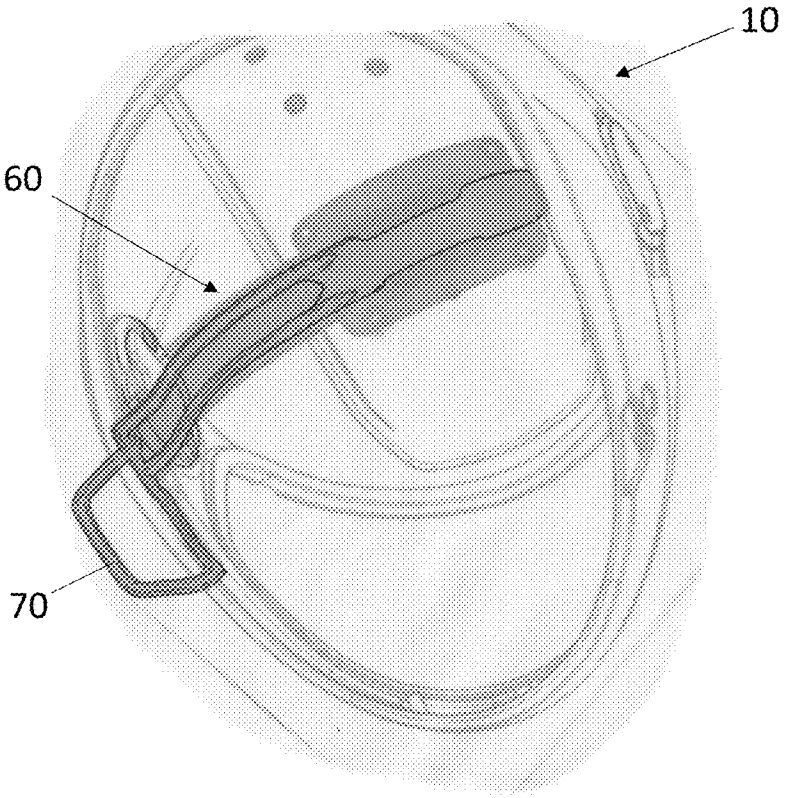
FIGS. 13 to 16 are various views of alternate embodiments of the helmet, showing different embodiments of the release mechanism.
Figure 13:
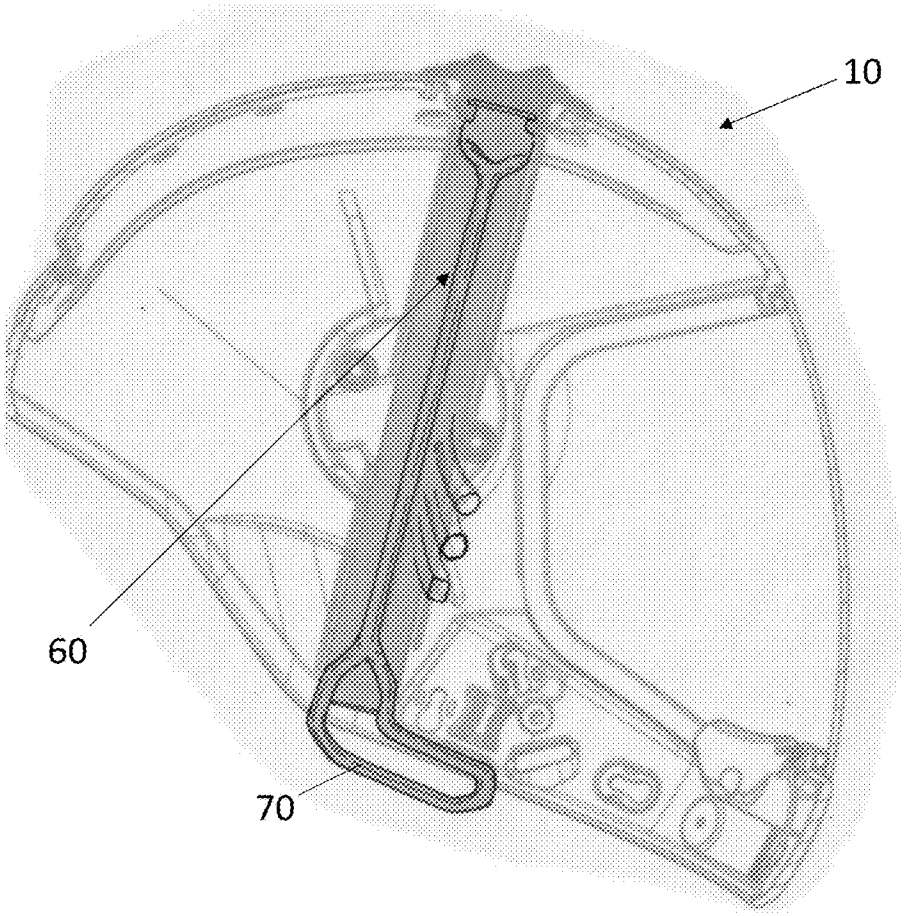
Figure 16:
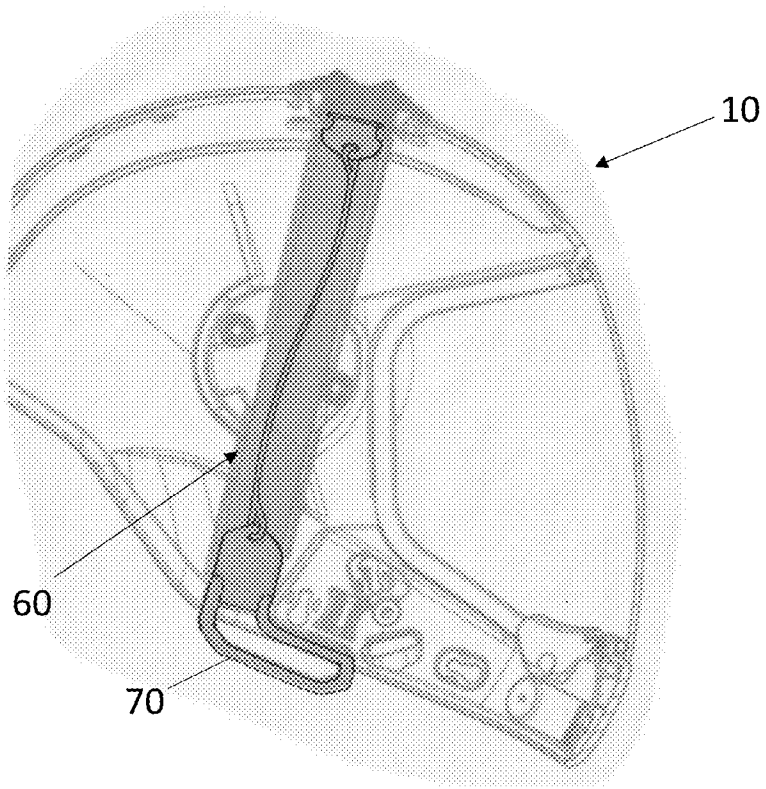
Figure 15:
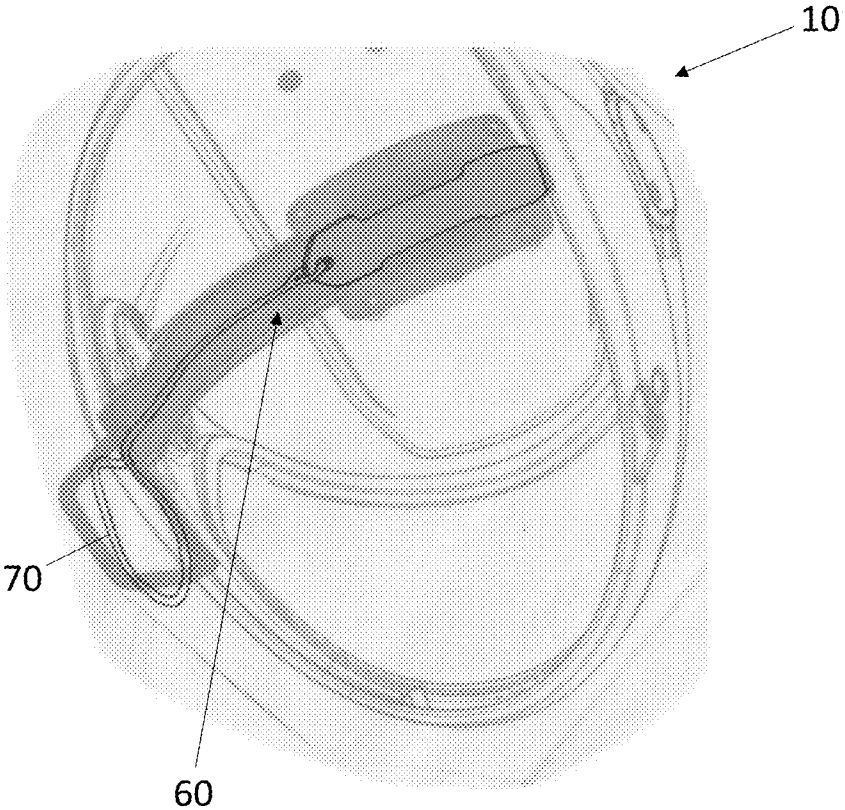

With reference to FIG. 12, the helmet 10 can include a visual indicator 64 configured to provide visual indication of the engagement of the release mechanism with the mounting fixture 30. In this embodiment, the visual indicator 64 includes a hole 65 defined through the helmet shell 12 and/or through the fixture plate 36 in order to provide visual access to within the helmet shell 12. The hole 65 is preferably aligned with the central passage of the latch portion such that the strap extends over and/or past the hole 65 from within the helmet. Therefore, visual indication of the engagement of the strap with the latch portion is provided when the hole 65 is covered by the strap. In some embodiments, the hole 65 can be superposed with a colored indicator, such as a red piece of material, indicating that the strap has not reached its destination (i.e., is not engaged with the latch portion). Therefore, in a skydiving exercise, for example, if the color red is visible through the hole, it signifies "no go" (i.e., do not jump), and if the color black is visible (or any given color of the strap), it signifies "go" (i.e., that the accessory is adequately fastened, and you can jump).

Referring back to FIGS. 9 to 11, the helmet 10 can be provided with a mounting plate 90 removably connectable to the helmet shell 12 (e.g., via fasteners). The mounting plate 90 can have the fixture opening defined therethrough. As such, the mounting plate 90 can be removed and replaced within another mounting plate 90 when required (e.g., for replacement of a damaged part, for installing a mounting plate 90 having a fixture opening of a different shape and/or size, etc.). It should also be appreciated that, in some embodiments, the helmet 10 can be provided with a plurality of mounting plates 90 having respective fixture openings having respective shapes, sizes and/or configurations. It is noted that at least one of the mounting plates 90 can alternatively be "solid" (i.e., not provided with a fixture opening) such that the helmet 10 can be configured as a standard helmet which is not adapted to have an accessory mounted thereto via the mounting fixture 30.

As may now be better appreciated, the helmet 10 of the present disclosure can be advantageous in that it provides a helmet with a fastening assembly for an accessory capable of being disconnected from the helmet in a more efficient, more precise, more accurate, more reliable, more adjustable, more versatile, more adaptable, more ergonomic and/or more desirable manner, than what is possible with other existing conventional devices. The fastening assembly provides a rigid, or semi-rigid, "push to lock" system, where the strap can be slid along the snag-free channel leading to the mounting fixture installed at the top of the helmet.

It should be appreciated from the present disclosure that the various implementations of the helmet and related components (e.g., the fastening assembly) enable the user to attach an accessory (e.g., a camera) on a helmet easily and safely, and simply pull a lever on the lower ridge of the helmet to disconnect the camera when desired/required, such as in the event of an entanglement to the parachute, or anything else near the helmet. The helmet also allows for easier camera maintenance (e.g., recharge, download images, etc.) by quickly releasing the camera from the helmet and then reattaching it back as simply.

The present disclosure may be embodied in other specific forms without departing from the subject matter of the claims. The described example implementations are to be considered in all respects as being only illustrative and not restrictive. For example, in the implementations described herein, the strap of the release mechanism is described and shown as a generally flat strip of material. However, and with reference to FIGS. 13 to 16, it is appreciated that the strap can have any other suitable configuration(s), such as a belt, a leash, a band, a thong, a pole, a handle, a stem, etc., or a combination thereof. The strap can be completely rigid, or have only portions thereof be rigid, with the rest being soft or semi-rigid, for example. In some embodiments, the helmet can be provided with a jettison, or ejection system, configured to push the mounting fixture away from the helmet when the strap is removed from the latch portion. For example, one or more resilient elements (e.g., springs) can be provided between the fixture plate of the mounting fixture and the outer surface of the helmet to bias the fixture plate away from the helmet. As such, when the strap is removed from the latch portion, the springs would push the mounting fixture away from the helmet, ensuring that the accessory is released from the helmet.

The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the present disclosure, an embodiment is an example or implementation of the helmet, and corresponding parts. The various appearances of "one embodiment," "an embodiment" or "some embodiments" do not necessarily all refer to the same embodiments. Although various features may be described in the context of a single embodiment, the features may also be provided separately or in any suitable combination. Conversely, although the helmet may be described herein in the context of separate embodiments for clarity, it may also be implemented in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings include various components and although the optional configurations of the helmet as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperations thereinbetween, as well as other suitable geometrical configurations may be used for the implementation and use of the helmet, and corresponding parts, as briefly explained and as can be easily inferred herefrom, without departing from the scope of the disclosure.

The invention claimed is:

1. A helmet comprising:

a helmet shell defining an internal cavity; and a fastening assembly connectable to the helmet shell, the fastening assembly comprising:

a mounting fixture mountable to the helmet shell and comprising a latch portion releasably connected to the helmet shell and a coupling portion extending from the latch portion and configured to have an accessory connected thereto, the latch portion being operable between a connected configuration, where the latch portion engages the helmet shell and secures the mounting fixture to the helmet shell, and a disconnected configuration, where the latch portion disengages the helmet shell to enable disconnection and removal of the mounting fixture from the helmet shell; and a release mechanism comprising a release member configured to engage with the latch portion for operation thereof in the connected configuration, the release member being further configured to disengage from the latch portion upon operation of the release mechanism in order to operate the latch portion from the connected configuration to the disconnected configuration to enable disconnection and removal of the latch portion and the coupling portion from the helmet, wherein the mounting fixture is a one-piece unit such that engagement of the latch portion to the helmet shell also secures the coupling portion and the accessory to the helmet shell, and wherein operating the release mechanism enables disconnection of the latch portion, the coupling portion and the accessory from the helmet.

2. The helmet according to claim 1, wherein the helmet shell further comprises a fixture opening defined through the helmet shell such that the internal cavity communicates with a surrounding environment via the fixture opening, the fixture opening being shaped and sized to enable the latch portion to extend therethrough and connect to the helmet shell from within.

3. The helmet according to claim 2, wherein the fixture opening comprises an opening perimeter defining a latching edge, and wherein the latch portion comprises latching legs connected to and extending from the coupling portion at a proximal end thereof, each latching leg being provided with a latching foot extending from a distal end thereof and adapted to connect to the latching edge when operating the latch portion in the connected configuration.

4. The helmet according to claim 3, wherein the latching portion comprises a pair of latching legs extending opposite one another and defining a central passage therebetween, and wherein the release mechanism comprises a strap shaped and adapted to engage the central passage and displace the latching legs to position each latching foot below the latching edge for becoming coupled thereto.

5. The helmet according to claim 4, wherein the central passage has a passage width, and the strap has a strap width, the strap width being greater than the passage width such that the strap is adapted to push the latching legs outwardly away from one another when engaging the central passage.

6. The helmet according to claim 5, wherein the strap comprises a distal end having an end width, the end width being smaller than the passage width to facilitate engagement of the strap within the central passage.

7. The helmet according to 4, wherein the latching legs are shaped and adapted to bias each latching foot inwardly towards one another, and wherein disengaging the strap from the central passage enables the latching feet to move inwardly and away from the latching edge for disconnecting therefrom and allow disconnection of the mounting fixture from the helmet shell.

8. The helmet according to claim 4, wherein each latching foot comprises an outer protrusion shaped and adapted to extend below the helmet shell and hook onto the respective sections of the latching edge, and further comprises an inner protrusion shaped and adapted to extend below the strap to facilitate engagement of the strap and support the strap through the central passage.

9. The helmet according to claim 8, wherein the mounting fixture comprises a strap guide extending within the central passage for guiding the strap between the latching legs and along the inner protrusions.

10. The helmet according to claim 9, wherein the strap guide comprises one or more support members, and wherein engagement of the strap within the central passage biases the one or more support members downwardly and against the strap to at least partially secure the strap between the support members and the inner protrusions.

11. The helmet according to claim 4, wherein the release mechanism comprises a handle connected to the strap, the handle being positioned proximate a bottom portion of the helmet shell and accessible from an exterior of the helmet shell, and wherein pulling the handle disengages the strap from the central passage to operate the latch portion in the disconnected configuration.

12. The helmet according to claim 11, wherein the handle comprises a tab extending therefrom, and wherein the helmet shell comprises a tab slot defined in a thickness of the helmet shell and opening proximate the bottom portion, the tab being adapted to engage the tab slot when engaging the strap with the latch portion.

13. The helmet according to claim 4, wherein the helmet shell comprises a strap channel defined along an inner surface of the helmet shell, the strap channel extending from the bottom portion of the helmet to proximate the fixture opening, and wherein the strap is adapted to slide along the strap channel prior to engaging the latch portion.

14. The helmet according to claim 13, further comprising a foam liner provided within the helmet shell, and wherein the strap is adapted to slide along the strap channel between the foam liner and the helmet shell.

15. The helmet according to claim 4, wherein the fastening assembly comprises a visual indicator adapted to provide visual indication of the engagement of the strap with the latch portion from an exterior of the helmet.

16. The helmet according to claim 15, wherein mounting fixture comprises a fixture plate adapted to abut against the helmet shell, and wherein the visual indicator comprises a hole defined through the fixture plate adjacent the coupling portion and aligned with the central passage such that the strap covers the hole when engaged with the latch portion.

17. A helmet comprising:

a helmet shell having an outer surface and an inner surface defining an internal cavity, the helmet shell also having a fixture opening defined therethrough such that the internal cavity communicates with a surrounding environment via the fixture opening;

a helmet liner provided along the inner surface; and a fastening assembly comprising:

a mounting fixture comprising a latch portion releasably connectable to the helmet shell; and a release mechanism operatively connectable to the mounting fixture, wherein connection of the release mechanism to the mounting fixture secures the mounting fixture to the helmet shell, and disconnection of the release mechanism from the mounting fixture enables disconnection of the mounting fixture from the helmet shell, wherein the fixture opening is shaped and sized to enable the latch portion to extend therethrough and connect to the helmet shell from within.

18. A fastening assembly for connecting an accessory to a helmet shell of a helmet, comprising:

a one-piece mounting fixture having a coupling portion adapted to hold the accessory and a latch portion operable between a connected configuration, where the latch portion is connected to the helmet shell to secure the one-piece mounting fixture to the helmet, and a disconnected configuration, where the latch portion is disconnected from the helmet shell to enable disconnection and removal of the one-piece mounting fixture and the accessory from the helmet; and a release mechanism comprising a release member removably engageable with the latch portion, wherein the release member is configured to engage with the latch portion for operation thereof in the connected configuration, and wherein the release member is configured to disengage from the latch portion upon operation of the release mechanism in order to operate the latch portion from the connected configuration to the disconnected configuration to enable disconnection and removal of the one-piece mounting fixture and the accessory from the helmet.

* * * * *